US009278785B2

(12) United States Patent
Giovannini et al.

(10) Patent No.: US 9,278,785 B2
(45) Date of Patent: Mar. 8, 2016

(54) CONTAINER FOR RECYCLABLE CLOSURE AND CONTAINER CLOSURE ASSEMBLY WITH SAID CONTAINER

(75) Inventors: Marco Giovannini, Milan (IT); Luca Viale, Alessandria (IT)

(73) Assignee: Guala Closures S.p.A., Alessandria (IT)

( * ) Notice: Subject to any disclaimer, the term of this patent is extended or adjusted under 35 U.S.C. 154(b) by 46 days.

(21) Appl. No.: 14/115,835

(22) PCT Filed: May 3, 2012

(86) PCT No.: PCT/IB2012/052222

§ 371 (c)(1),
(2), (4) Date: Nov. 5, 2013

(87) PCT Pub. No.: WO2012/150569

PCT Pub. Date: Nov. 8, 2012

(65) Prior Publication Data

US 2014/0103003 A1 Apr. 17, 2014

(30) Foreign Application Priority Data

May 5, 2011 (WO) ..... PCT/IT2011/000141

(51) Int. Cl.

| | |
|---|---|
| ***B65D 41/04*** | (2006.01) |
| ***B65D 1/02*** | (2006.01) |
| ***B65D 41/34*** | (2006.01) |

(52) U.S. Cl.

CPC ..... *B65D 41/34* (2013.01); *B65D 1/0246* (2013.01); *B65D 41/348* (2013.01); *B65D 41/3452* (2013.01)

(58) Field of Classification Search

CPC ..... B65D 1/0246; B65D 1/02; B65D 41/04; B65D 41/34; B65D 41/3452; B65D 41/348

USPC ..... 215/44, 40, 329

See application file for complete search history.

(56) References Cited

U.S. PATENT DOCUMENTS

| | | | | | |
|---|---|---|---|---|---|
| 1,938,063 | A | * | 12/1933 | Burke | 215/252 |
| 1,982,786 | A | * | 12/1934 | Burke | 215/253 |
| 2,054,012 | A | * | 9/1936 | Teller | 215/252 |
| 2,124,874 | A | * | 7/1938 | Conner et al. | 215/251 |
| 3,001,657 | A | * | 9/1961 | Gamble | 215/252 |
| 3,559,833 | A | * | 2/1971 | Alonso | 215/44 |
| 3,690,496 | A | * | 9/1972 | Gibson | 215/217 |
| 3,784,045 | A | * | 1/1974 | Komendowski | 220/277 |
| 4,156,490 | A | * | 5/1979 | Peraboni | 215/252 |
| 7,451,885 | B2 | * | 11/2008 | Nyman et al. | 215/252 |
| 2006/0006194 | A1 | * | 1/2006 | Niggemyer et al. | 222/107 |

FOREIGN PATENT DOCUMENTS

| | | |
|---|---|---|
| GB | 362101 | 12/1931 |
| WO | 2008095863 | 8/2008 |

* cited by examiner

*Primary Examiner* — Mickey Yu
*Assistant Examiner* — Niki Eloshway
(74) *Attorney, Agent, or Firm* — Alan G. Towner, Esq.; Pietragallo Gordon Alfano Bosick & Raspanti, LLP

(57) ABSTRACT

The present invention relates to a tamper-evident closure of the roll-on type which comprises an engagement surface, suitable for engaging with a corresponding engagement surface provided on the neck of a container, wherein the engagement surfaces permit the complete removal of the closure after the first opening.

13 Claims, 8 Drawing Sheets

CONTAINER FOR RECYCLABLE CLOSURE AND CONTAINER CLOSURE ASSEMBLY WITH SAID CONTAINER

TECHNICAL FIELD

The present invention relates to a container for recyclable closure and to a container closure assembly having such a container.

BACKGROUND OF THE INVENTION

Tamper-evident closures are known in the art. Such closures generally comprise a true and proper cap, removably associated with the remainder of the closure, and a tamper-evident element, or one for making the first opening evident.

In the majority of closures, there is at least one element which remains attached to the container after the first opening. Normally, such an element is intended and designed to remain attached to the container for the entire useful life of the container.

With the increase in sensitivity regarding the environmental impact of products, there has gradually become widespread the need to also reduce the environmental impact of safety closures.

It is known that in order to reduce the environmental impact of an object it is possible to produce it by means of components all made of the same material or in any case easily separable from one another.

In the particular case of safety closures, normally comprising an element intended to remain on the container for the entire useful life of the latter, it is found that it is not in fact easy, with normal separation techniques adopted in the recycling field, to separate the container from the element fitted onto it.

The element therefore becomes a pollutant for the recycling of the container.

The documents WO2008/95863, U.S. Pat. Nos. 4,156,490, 3,001,657, GB 407386, GB 374394, GB 362101, FR 1108212 and FR 723220 disclose containers having a neck, having a lower screw thread and an upper screw thread, to which there is applied a closure having a lower portion in engagement with the lower thread and an upper portion in engagement with the upper thread. Upon first opening, the lower thread is configured to retain the lower portion on the container. However, the container does not allow removal of the lower portion after the first opening.

It would therefore be desirable to be able to produce a container which allows ready separation of the closure so as to be able to recycle the container better without any element of the closure being able to become a pollutant for the purposes of the recycling of the container itself.

In view of the prior art described, it is therefore an object of the present invention to provide a container which can be adapted to receive a completely removable tamper-evident closure, making both recyclable separately.

In addition, the present invention makes it possible to obtain advantages in terms of simplicity of production, greater strength, greater compactness and/or greater versatility.

SUMMARY OF THE INVENTION

According to the present invention, this object is achieved by means of a container comprising a neck and a mouth, the neck extending mainly along a longitudinal axis and comprising an upper portion comprising a screw thread provided around the longitudinal axis, a lower portion, an engagement surface transverse to a plane perpendicular to the longitudinal axis, in which the engagement surface comprises a first part which extends on said lower portion, wherein said screw thread has a crest diameter and said engagement surface defines a minimum diameter, said crest diameter is greater than said minimum diameter, the engagement surface comprises a second part which extends on the upper portion, the second part of the engagement surface overlaps the screw thread over at least a longitudinal portion of the neck.

BRIEF DESCRIPTION OF THE DRAWINGS

The features and advantages of the present invention will become clear from the following detailed description of a practical form of embodiment, provided by way of non-limiting example with reference to the appended drawings, in which.

DETAILED DESCRIPTION

Figure 1:
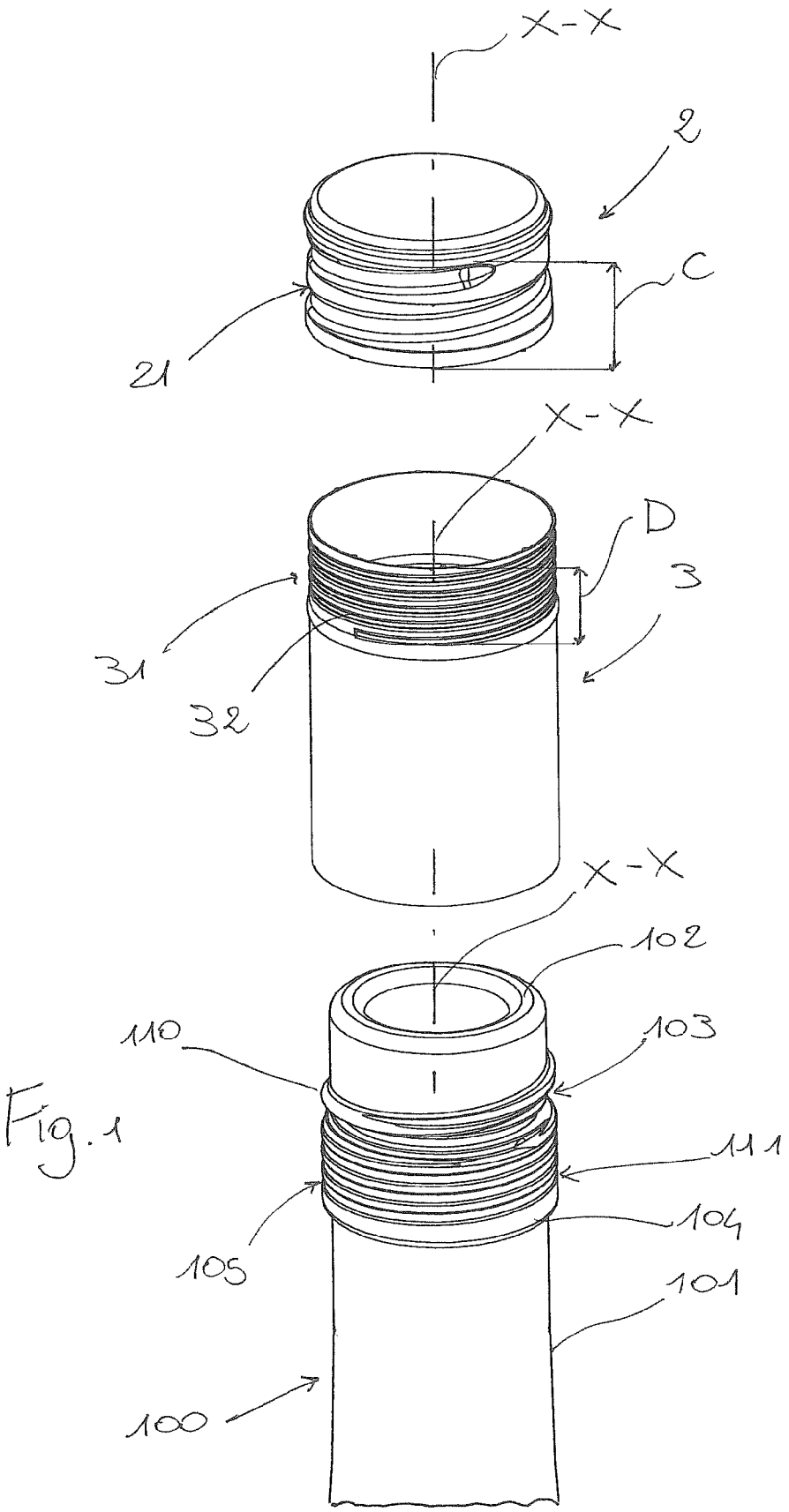
FIG. 1 is an exploded perspective view of a preferred embodiment of a container closure assembly according to the present invention, after the first opening.

Even when not explicitly set out, the individual features described with reference to the specific embodiments should be understood as being additional to and/or interchangeable with other features, described with reference to other exemplary embodiments.

It should also be noted that there is not intended to be understood to be claimed (and therefore a specific subject of deletion) anything which might prove to be already known or obvious to a person skilled in the art, before the priority date.

In the course of the description and of the claims of the present specifications, the word "comprises" and variations thereof, such as "comprising", is not intended to exclude other elements, parts or additional components, nor further steps or stages.

With reference to the Figures, the reference numeral 100 designates a container in accordance with an embodiment of the present invention and 10 designates an assembly of the container 100 with an anti-tamper closure 1.

The container 100 comprises a neck 101 which extends along a predetermined longitudinal axis X-X and which ends in a mouth 102. A screw thread 103, and optionally a bead 104, is formed on the lateral surface of the neck 101 around the longitudinal axis X-X.

The neck 101 comprises an upper portion 110 and a lower portion 111.

The upper portion 110 comprises the screw thread 103.

The closure 1 also extends along the longitudinal axis X-X and comprises an upper portion 2, comprising a screw thread 21 formed around the longitudinal axis X-X, and a lower portion 3 comprising an engagement surface 32 which is transverse relative to a plane perpendicular to the longitudinal axis X-X. The upper portion 2 of the closure 1 is intended to be coupled to the neck 101, in particular to the screw thread 103. Depending on the production techniques, the upper portion 2 may be produced with or without a screw thread 21 which can be coupled to the screw thread 103: in the first case, the screw thread 21 could be provided on a separate element, for example made of polymer material, inside the upper portion 2 itself; in the second case (which can be seen in the Figures), the screw thread 21 could be produced directly by copying at the time of the fitting of the closure 1 onto the container 100.

The upper portion 2 is the one which is intended to be removed from the neck 101 at the time of the first opening.

The portion intended to remain on the container 100 at the time of the first opening is the lower portion 3.

The upper portion 2 and the lower portion 3 are connected to each other by means of an anti-tamper (or tamper-evident) system which is activated during the first opening.

The upper portion 2 is intended to be removed from the container 100 immediately after the first opening, while the lower portion 3 is intended to be removed from the container 100 only following the activation of the tamper-evident device.

In other words, the upper portion 2 and the lower portion 3 can be connected to each other in such a manner as to allow the transfer of torque from the upper portion 2 to the lower portion 3, so that, during the first opening, a rotation of the lower portion 3 corresponds to a rotation of the upper portion 2.

The time of the first opening therefore becomes the time when the upper portion 2 and the lower portion 3 are disconnected from each other, or at least the time when the torque which they can transfer from one to the other becomes negligible with respect to the condition existing after the end of the application of the closure 1 onto the container 100 (or rather at the end of the bottling cycle).

The connection may be effected by means of a breakable line of weakening, for example having a reduced thickness or with bridges, or by means of non-positive coupling, without there being any continuity of material between the two.

An example of non-positive coupling is known for example from EP 1964787 B1, in which the element intended to be removed at the first opening and the element intended to remain on the container are coupled by means of a substantially annular groove.

In the patent cited, the substantially annular groove is provided on an element intended to remain integral with the container during the first opening; however, it is clear to the person skilled in the art that the opposite embodiment, with the grooved element intended to remain integral with the upper element (the one which is removed during the first opening) is a technically equivalent solution.

The upper portion 2 and the lower portion 3 are therefore connected to each other in such a way that their separation may lead to an effect of making evident the first opening: the non-positive coupling is lost during the first opening, or the weakened line breaks during the first opening. In the latter case, the first opening may also be regarded as the transient state which coincides with the breaking of the weakened line.

In the embodiment in the Figures, the upper portion 2 and the lower portion 3 are joined by breakable bridges 23.

The lower portion 3 comprises elements 31 which, when the lower portion 3 is coupled to the container 100, are capable of preventing the lower portion 3 itself from being extracted from the container 100 at a velocity equal to or greater than that at which the upper portion 2 is extracted from the container 100.

In other words, while in the prior art the lower portion 3 was attached to the container 100 by means which prevented a relative longitudinal extraction movement between the container 100 and the lower portion 3 itself, for example by means of a longitudinal abutment against the bead 104, according to the present invention, during the first opening, the velocity of the lower portion 3 along the longitudinal axis X-X is less than the velocity of the upper portion 2 along the longitudinal axis X-X, taking the velocity along the longitudinal axis X-X of the upper portion 2 to be positive and the velocity along the longitudinal axis X-X in the opposite direction to be negative.

However, the bead 104, which in the prior art lay on a plane substantially perpendicular to the longitudinal axis X-X and was intended to retain the closure 1 axially, is not necessary for obtaining the advantages of the present invention and may either be present in the container 100 or absent.

The container 100 is advantageously a bottle, for example made of ceramic material, PET or another polymer, coloured or colourless glass, preferably made of colourless transparent glass (commonly also called "clear glass").

However, the container 100 according to the present invention comprises, besides the screw thread 103, an engagement surface 105, substantially not perpendicular to the axis X-X, in other words transverse to a plane perpendicular to the longitudinal axis X-X.

The engagement surface 105 comprises a first part 105*a* which extends onto the lower portion 111 and a second part 105*b* which extends onto the upper portion 110. It should be noted that the first part 105*a* and the second part 105*b* have the same features. If the engagement surface 105 is formed as a screw thread, the two parts 105*a* and 105*b* have the same pitch and inclination with respect to the longitudinal axis X-X.

In accordance with an embodiment, the upper end of the first part 105*a* is provided adjacent, advantageously contiguous, to the lower end of the screw thread 103. In greater detail, the upper end of the first part 105*a* is provided adjacent, advantageously contiguous, to the lower end of the second part 105*b*.

Advantageously, the engagement surface 105 is substantially helical in shape (it may be interrupted or, more advantageously, continuous).

Advantageously, the engagement surface 105 of substantially helical shape is such that, during the first opening, the velocity of the lower element 3 along the longitudinal axis X-X is less than the velocity of the upper element 2 along the longitudinal axis X-X.

The inclination of the engagement surface 105 with respect to the axis X-X may be less than that of the screw thread 103 (taking the inclination of the screw thread 103 to be positive). Preferably, the engagement surface 105 is not completely perpendicular to the axis X-X (or rather does not close in the form of a ring about the axis X-X).

Advantageously, the inclination of the engagement surface 105 with respect to the longitudinal axis X-X may be concordant with that of the screw thread 103, but less pronounced, or may be discordant in such a manner that, during the first opening, the lower element 3 is in practice "screwed on", moving away from the mouth 102 of the container 100. Therefore, the inclination of the engagement surface 105 with respect to the longitudinal axis X-X may be positive or negative.

In particular, since the screw thread 103 is normally right-hand, the engagement surface 105 could substantially define a right-hand helix with a pitch which is less than that of the screw thread 103, or a left-hand helix.

The engagement surface 32, provided on the lower portion 3, corresponds to the engagement surface 105 and is capable of engaging therewith.

The engagement surface 32, like the screw thread 21, could be provided on the lower portion 3 by copying or by means of an inner element inserted into the lower portion 3 itself.

Similarly to the screw thread 103 and the engagement surface 105, with the inclination of the screw thread 21 with respect to the longitudinal axis X-X being defined as being positive, the inclination of the engagement surface 32 with respect to the longitudinal axis X-X is lower than that of the screw thread 21.

The inclination of the engagement surface 32 with respect to the longitudinal axis X-X may be positive or negative.

Advantageously, the longitudinal extent A of the screw thread 103 and the longitudinal extent B of the engagement surface 105 will be such that, after the first opening, the lower portion 3 may still be engaged with the engagement surface 105, in particular with the first part 105*a* of the engagement surface 105.

In other words, the lower portion 3 will still be engaged with the first part 105*a* of the engagement surface 105 when the upper portion 2 is already completely detachable from the container 100 (or rather when the upper portion 2 is completely disengaged from the screw thread 103).

Similarly, the longitudinal extent C of the screw thread 21 and the longitudinal extent D of the engagement surface 32 will be such that, when the upper portion 2 is completely detachable from the container 100 (or rather when the upper portion 2 is completely disengaged from the screw thread 103), the lower portion 3 may still be engaged with the first part 105*a* of the engagement surface 105.

The effective ratios between the longitudinal extents A, B, C, D depend on the angles of inclination with respect to the axis X-X (or with respect to a plane perpendicular thereto) of the engagement surfaces 32, 105 and of the screw threads 21, 103, and also on the relative longitudinal displacement which it is necessary to impart to the upper portion 2 and lower portion 3 in order to be able to separate them.

When the upper portion 2 is separated from the lower portion 3, there can no longer be any transmission of force between them, and therefore the extraction of the upper portion 2 no longer necessarily involves any movement of the lower portion 3.

The engagement surface 105 may be produced as a "positive" screw thread (therefore like the screw thread 103, in the Figures: or rather as a screw thread which visibly protrudes from a cylindrical surface), or "negative", as can be seen in the Figures, or rather a recess (or a channel) provided towards the inside of a cylindrical surface.

Advantageously, the engagement surface 105 and/or the screw thread 103 is/are longer than 150°, for example they are at least a half turn in length, for example at least 250°, for example at least 300°, for example at least 360°.

Advantageously, the first part 105*a* of the engagement surface 105, before the first opening (or rather after the fitting of the closure 1 onto the container 100), is already substantially engaged with the engagement surface 32 of the lower portion 3. This may also follow from the method of production, by copying.

In the preferred embodiment, therefore, it is not possible to have any substantial approach between the engagement surfaces 32 and 105 before they engage with one another.

Advantageously, the engagement surface 105 may also extend onto the screw thread 103. In particular, the second part 105*b* of the engagement surface 105 may extend onto the screw thread 103. In other words, the second part 105*b* of the engagement surface 105 overlaps the screw thread 103 over at least a longitudinal portion of the neck 101.

In the embodiment, the second part 105*b* of the engagement surface 105 overlaps the screw thread 103 over the longitudinal extent A of the screw thread 103.

According to one embodiment, the second part 105*b* of the engagement surface 105 intersects with the screw thread 103 over the longitudinal overlapping portion of the neck 101.

In greater detail, over the longitudinal overlapping portion of the neck 101, the second part 105*b* of the engagement surface 105 penetrates the screw thread 103.

Figure 2:
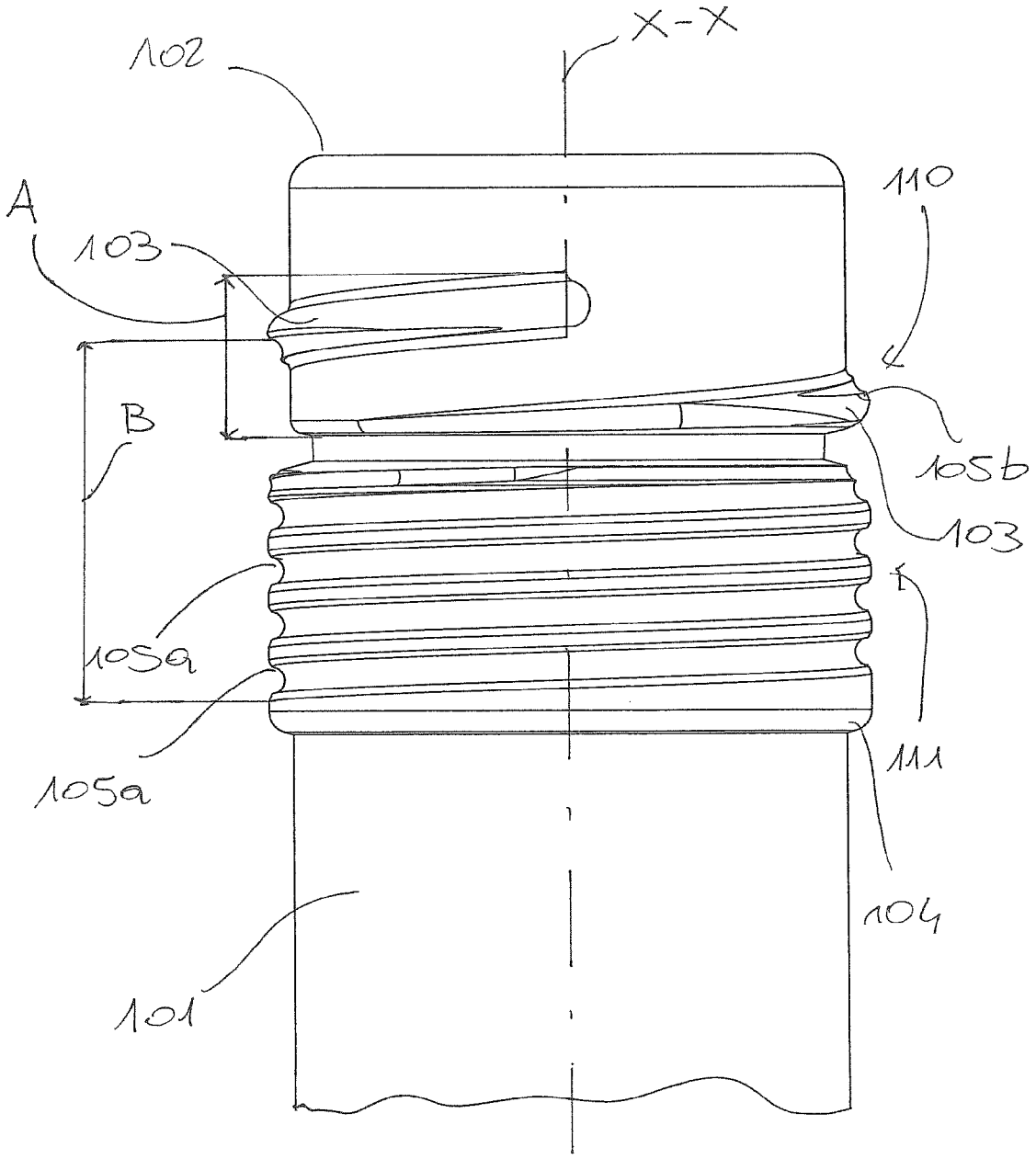
FIGS. 2 to 5 are various side views of the mouth of the container of FIG. 1.
Figure 3:
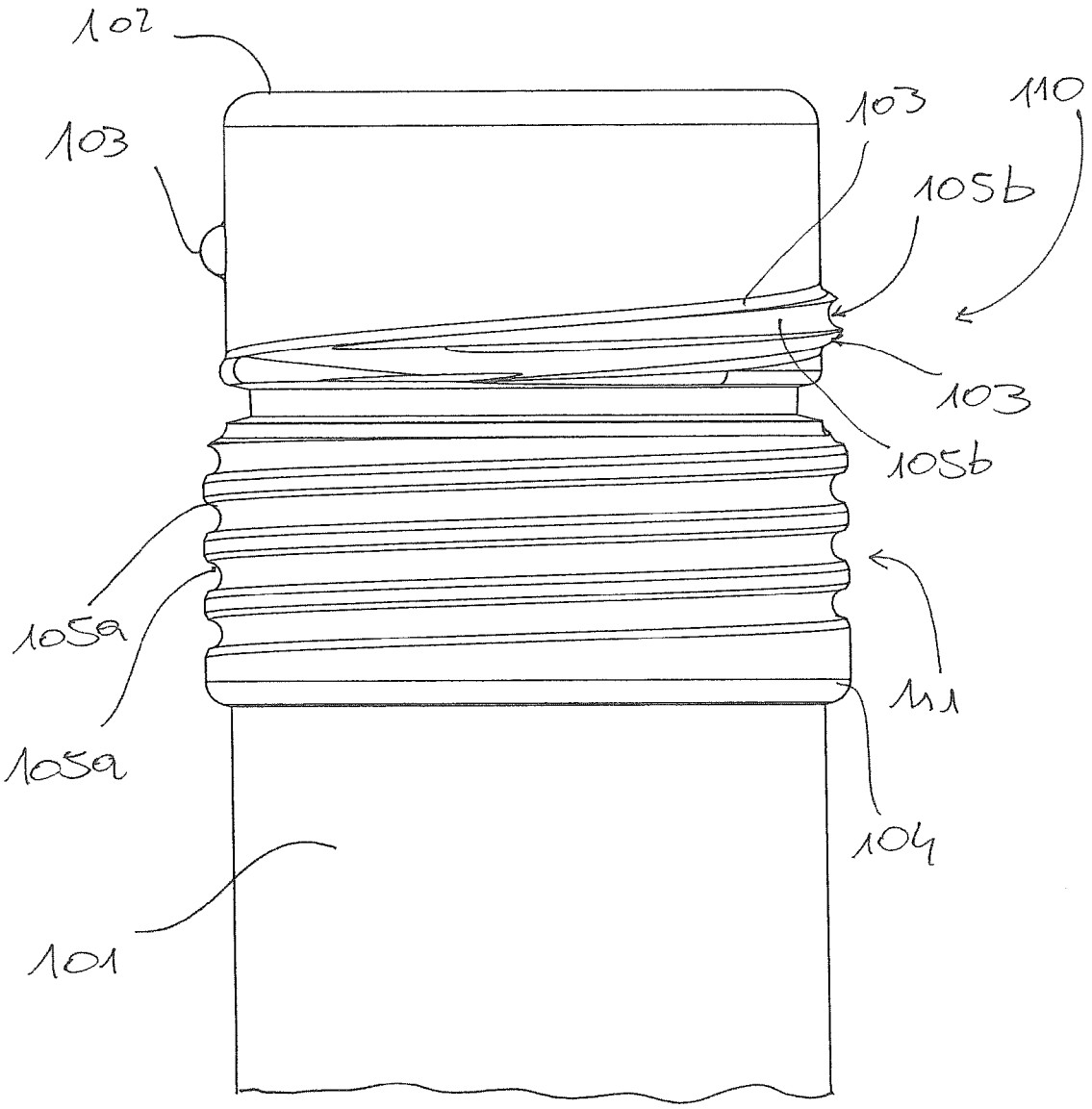
Figure 4:
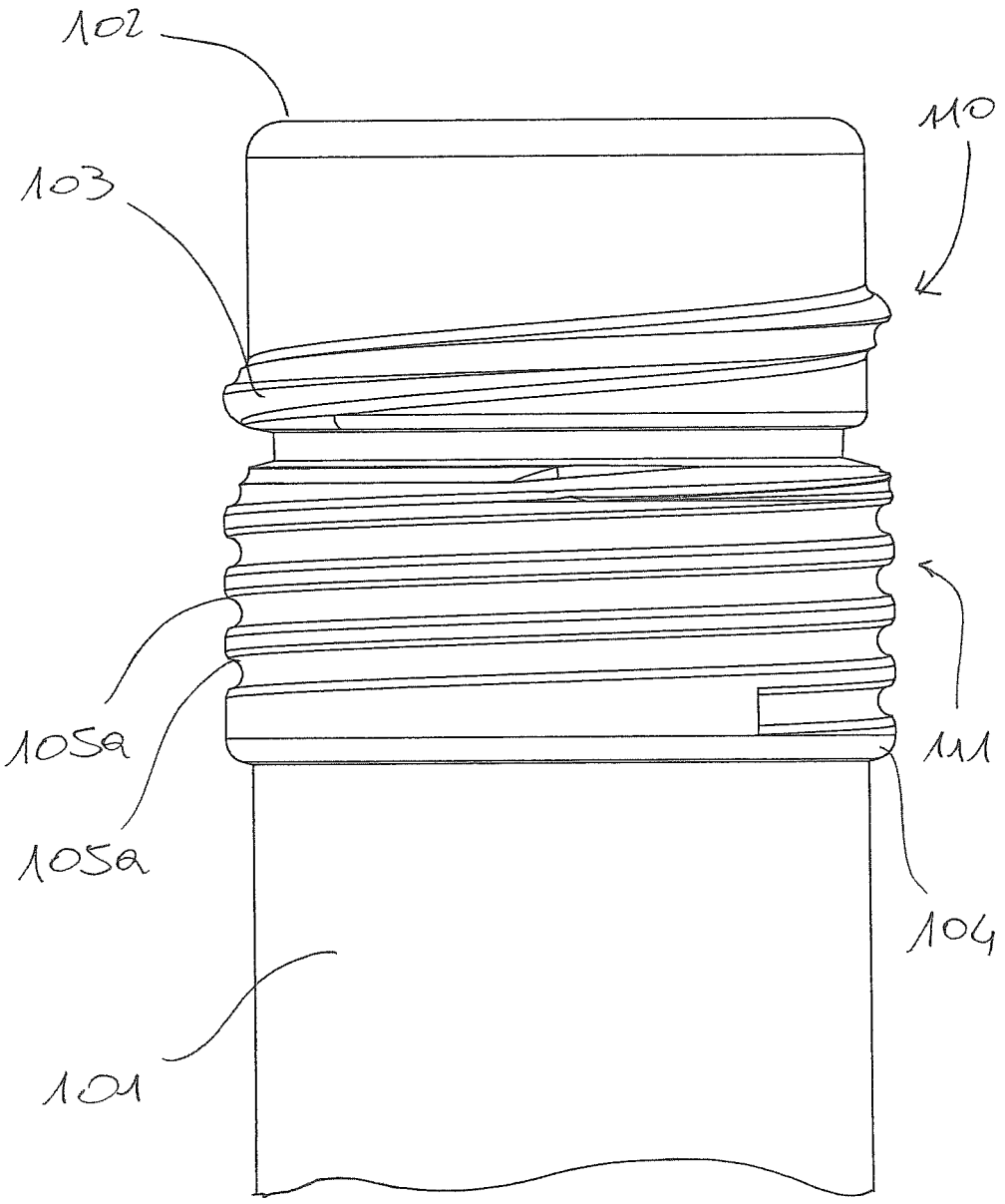
Figure 5:
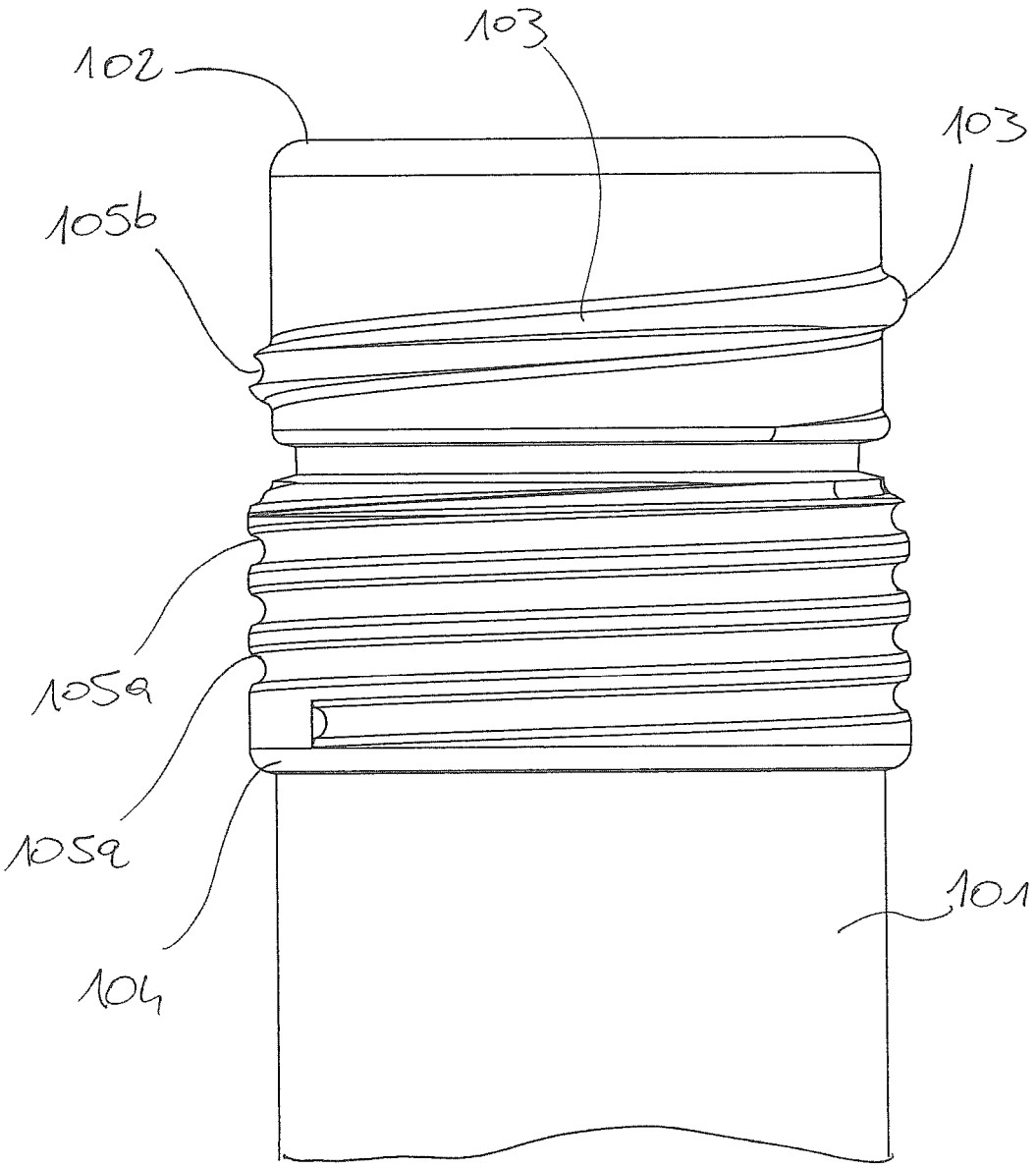
Figure 6:
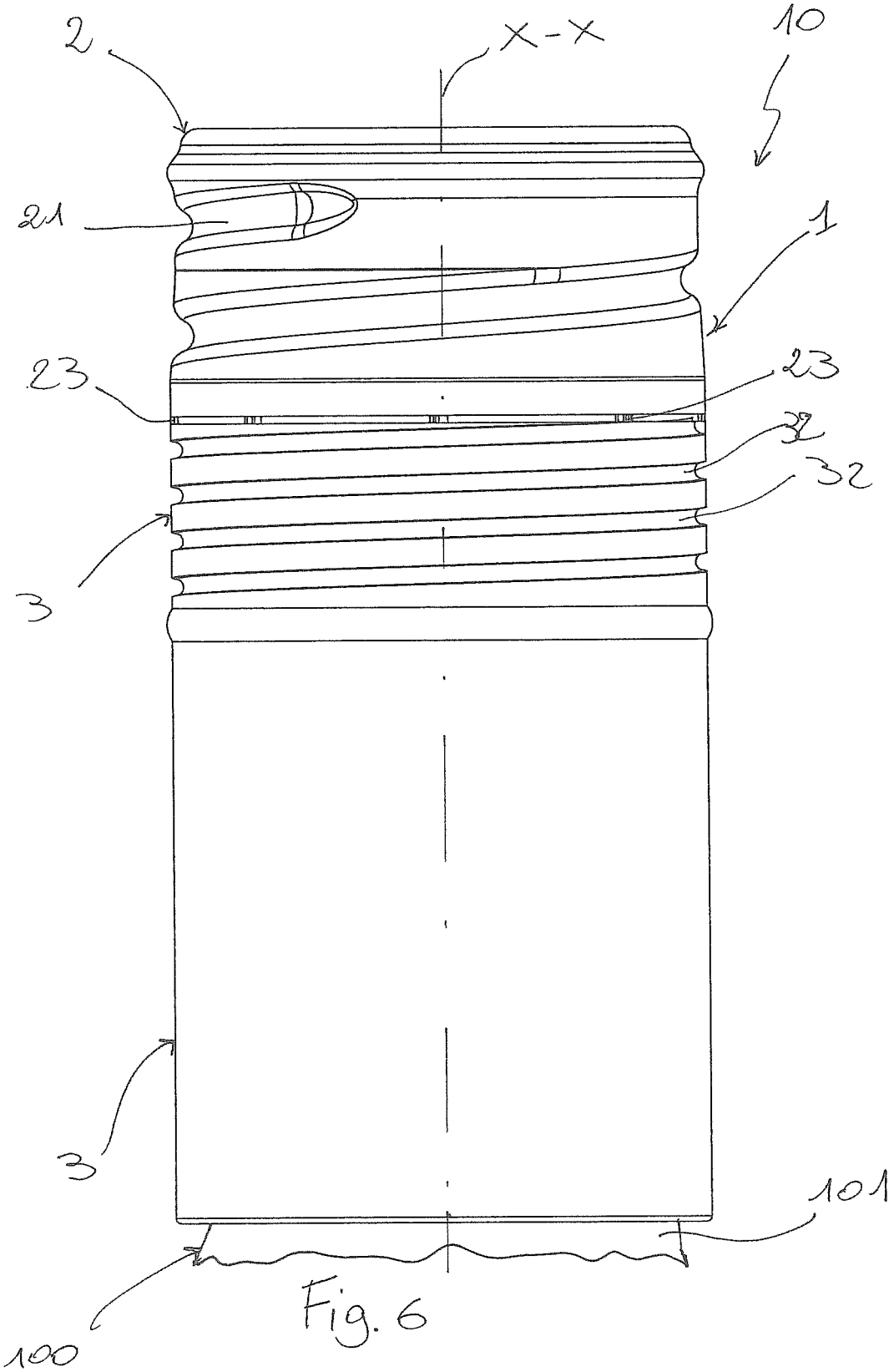
FIG. 6 is a side view of the container closure assembly of FIG. 1, before the first opening.
Figure 7:
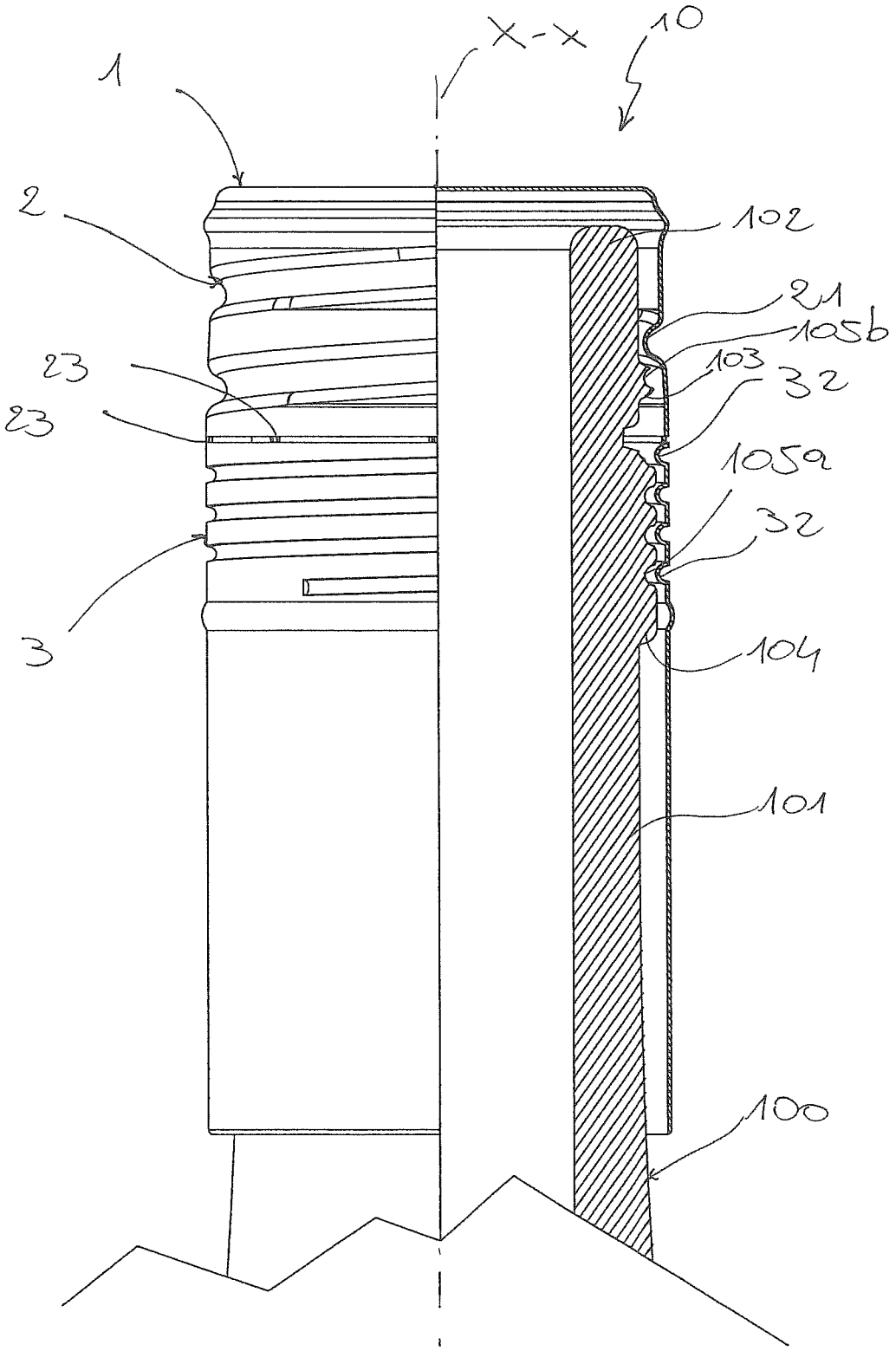
FIG. 7 is a cross-section of the container closure assembly of FIG. 6.
Figure 8:
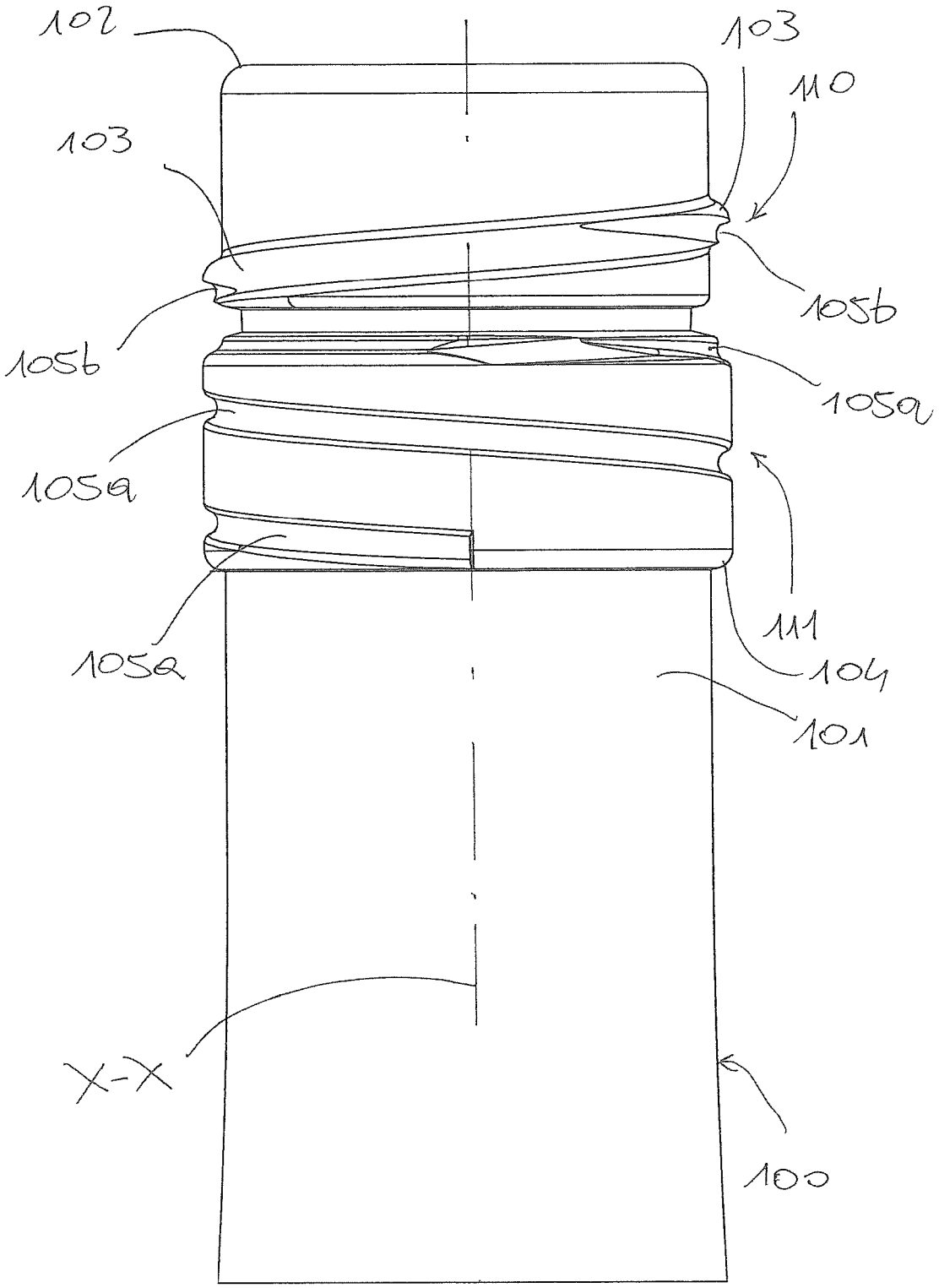
FIG. 8 is a side view of a mouth according to an alternative embodiment of the container of the present invention.

In other words, the second part 105*b* of the engagement surface 105 is formed on the screw thread 103, that is to say, engraved on the screw thread 103. As may be seen in FIGS. 2 to 5, the screw thread 103 has portions "removed" by the passage of the second part 105*b* of the engagement surface 105.

This not only allows a reduction in the total longitudinal extent of the neck portion 101 affected by the screw thread 103 and/or the engagement surface 105 even if, in this case, the engagement surface 105 and/or the screw thread 103 can be interrupted, for example, in the region of the overlap zone. The overlapping of the second part 105*b* of the engagement surface 105 on the screw thread 103 allows ready removal of the lower portion 3 of the closure 1 after the first opening.

It should be noted that the lower portion 3 has an engagement surface 32 which can be coupled to the engagement surface 105 and therefore both with the first part 105*a* and with the second part 105*b*.

Therefore, before the first opening, the screw thread 21 is coupled to the screw thread 103 of the container 100 and the engagement surface 32 is coupled to the first part 105*a* of the engagement surface 105.

During the first opening, a rotation of the closure 1 about the longitudinal axis X-X brings about removal of the upper portion 2 from the neck 101 of the container 100 whilst the lower portion 3 remains with the engagement surface 32 engaged with the first part 105*a* of the engagement surface 105 of the container 100.

After the first opening, a rotation of the lower portion 3 about the longitudinal axis X-X brings about engagement of the engagement surface 32 with the second part 105*b* of the engagement surface 105 of the container 100, which, it is recalled, is formed in the upper portion 110 of the neck 101, in particular it overlaps the screw thread 103, in order to allow removal of the lower portion 3 from the neck 101. Owing to the coupling of the engagement surface 32 with the second part 105*b* of the engagement surface 105 of the container 100, the lower portion 3 may be completely unscrewed because the engagement surface 32 can be readily moved into the second part 105*b* of the engagement surface 105, having a pitch compatible with the engagement surface 32 itself and being engraved on the upper portion 110 of the neck 101.

According to one embodiment, the crest diameter of the screw thread 103 is greater than the minimum diameter defined by the engagement surface 105.

Likewise, the maximum diameter of the screw thread 21 could be greater than the minimum diameter of the engagement surface 32.

In this manner, it will be possible to obtain a closure 1 which uses basic standard components (for example a cylindrical metal capsule) and which makes it possible to carry out the rolling of the closure 1 with the accuracy and speed required by an industrial process.

In particular, the crests of the screw thread 103 could define a diameter which is substantially equal to the outside diameter of the structure which defines the engagement surface 105.

This structure may therefore be the body of the screw thread on the lower surface of which the engagement surface 105 is provided or the body of the cylindrical surface on the inside of which are provided the depressions (or channels) of which the surface facing downwards provides the engagement surface 105.

Advantageously, the structure which defines the engagement surface 105 comprises cylindrical portions disposed between the screw threads (or the depressions) which provide the engagement surface 105.

Advantageously, since the closure 1 is produced by copying, the engagement surface 105 corresponds to the engagement surface 32. Similar considerations may be clearly valid for the screw thread 21 and/or for the engagement surface 32.

As explained above, the closure 1 may be of the type known as "roll-on", or rather of the type in which a capsule which is substantially smooth externally is positioned on the mouth 102 and on the neck 101 of the container and both the screw thread 21 and the engagement surface 32 are produced by means of a copying operation, or rather the lateral wall of the closure 1 is pressed against the outer surface of the container 100 by means of suitable pressing rollers, which deform the closure 1, so as to adapt it to the outer surface of the neck 101.

Advantageously, the closure 1 comprises an outer element made of metal material, for example comprising aluminium; preferably, the outer element is produced by drawing, starting from a sheet of aluminium.

In the embodiments shown in the Figures, the upper element 2 and the lower element 3 are made of aluminium and coincide with the above-mentioned outer element; other embodiments may provide for inner elements not necessarily made of metal material.

Advantageously, the container 100 does not comprise any feature of the sawtooth element type or the like, intended to dig themselves into the lower portion 3, making unscrewing thereof more difficult.

Clearly, a person skilled in the art, for the purpose of satisfying contingent and specific requirements, could apply numerous modifications and variants to the configurations described above.

Specifically, all that has been described as "substantially" circular (or annular) could be provided so as to be completely circular (or annular) or could comprise interruptions, but it being understood that such interruptions must permit the technical effect disclosed.

In addition, although the present description makes particular reference to a right-hand screw thread 103, the kinematic inversion which derives from producing the container 100 with a left-hand screw thread 103 (and the other features modified as a consequence) must be regarded as belonging to the teachings of the invention described herein.

Likewise, the screw thread 103 may be produced integrally with the neck 101 of the container 100, or provided on an added-on element (not shown in the Figures) and firmly attached to the container 100 itself. Such an added-on element may, for example, be made of polymer material and/or comprise the pouring lip of the container 100.

It should further be noted that the bead 104, when present, makes it possible to render the container 100 suitable for receiving both a closure 1 according to the present invention, and a standard closure, threaded only in the region of the upper element 2.

Such variants and modifications are, however, all included within the scope of protection of the invention as defined by the following claims.

The invention claimed is:

1. A container comprising a neck and a mouth, the neck extending mainly along a longitudinal axis and comprising:

an upper portion comprising a screw thread provided around the longitudinal axis, a lower portion, an engagement surface transverse to a plane perpendicular to the longitudinal axis, in which the engagement surface comprises a first part which extends on said lower portion, wherein said screw thread has a crest diameter and said first part of said engagement surface defines a minimum diameter, said crest diameter is greater than said minimum diameter of said first part of said engagement surface, the engagement surface comprises a second part which extends on the upper portion, and the second part of the engagement surface overlaps the screw thread over at least a longitudinal portion of the neck so that a radially protruding portion of said screw thread has a radially recessed portion defining said second part of said engagement surface, wherein said second part of said engagement surface is engageable with an engagement surface of a closure.

2. A container according to claim 1, wherein, over the at least one longitudinal portion of the neck, the second part of the engagement surface is threaded.

3. A container according to claim 2, wherein, an inclination of the screw thread with respect to the longitudinal axis is defined as being positive, and an inclination of the threaded second part of the engagement surface with respect to the longitudinal axis is less than the inclination of the screw thread.

4. A container according to claim 3, wherein the inclination of the threaded second part of the engagement surface with respect to the longitudinal axis is positive or negative.

5. A container according to claim 1, wherein the upper end of the first part of the engagement surface is provided adjacent to the lower end of the second part of the engagement surface.

6. A container closure assembly comprising:

a container, and an anti-tamper closure, said container comprising a neck and a mouth, the neck extending mainly along a longitudinal axis and comprising:

an upper portion comprising a screw thread provided around the longitudinal axis, a lower portion, and an engagement surface transverse to a plane perpendicular to the longitudinal axis, in which the engagement surface comprises a first part which extends on said lower portion, wherein said screw thread has a crest diameter and said first part of said engagement surface defines a minimum diameter, said crest diameter is greater than said minimum diameter of said first part of said engagement surface, the engagement surface comprises a second part which extends on the upper portion, and the second part of the engagement surface overlaps the screw thread over at least a longitudinal portion of the neck so that a radially protruding portion of said screw thread has a radially recessed portion defining said second part of said engagement surface, wherein said second part of said engagement surface is engageable with an engagement surface of the closure, said anti-tamper closure comprising:

an upper portion comprising a screw thread which is formed around the longitudinal axis and a lower portion which is connected to the upper portion of the closure by means of an anti-tamper system and which comprises an engagement surface which is transverse to a plane perpendicular to the longitudinal axis.

7. A container closure assembly according to claim 6, wherein, in the closure, a maximum diameter of the screw thread is greater than a minimum diameter of the engagement surface.

8. A container closure assembly according to claim 6, wherein, in the closure, an inclination of the screw thread with respect to the longitudinal axis defined as being positive, and an inclination of the engagement surface with respect to the longitudinal axis is lower than the inclination of the screw thread.

9. A container closure assembly according to claim 8, wherein, in the closure, the inclination of the engagement surface with respect to the longitudinal axis is positive or negative.

10. A container closure assembly according to claim 6, wherein the closure is of the roll-on type.

11. A container closure assembly according to claim 6, wherein, in the closure, the screw thread and/or the engagement surface are formed in an inner element which is internal with respect to the upper portion and/or lower portion, respectively.

12. A container closure assembly according to claim 6, wherein, in the closure, the upper portion and the lower portion comprise a metal element.

13. A container closure assembly according to claim 6, wherein, before a first opening, the screw thread of the closure is coupled to the screw thread of the container and the engagement surface of the closure is coupled to the first part of the engagement surface of the container, during the first opening, a rotation of the closure about the longitudinal axis causes removal of the upper portion of the closure from the neck of the container, and after the first opening, a rotation of the lower portion of the closure about the longitudinal axis causes engagement of the engagement surface of the closure with the second part of the engagement surface of the container in order to allow removal of the lower portion of the closure from the neck of the container.

* * * * *